US006726312B1

(12) United States Patent
Fujimura et al.

(10) Patent No.: US 6,726,312 B1
(45) Date of Patent: Apr. 27, 2004

(54) INK JET HEAD FOR USE IN A PRINTER

(75) Inventors: Tadamasa Fujimura, Yokohama (JP); Nobutaka Kajiura, Abiko (JP); Toshiharu Suganuma, Sagamihara (JP)

(73) Assignees: Kabushiki Kaisha Giken, Tokyo (JP); Aidaengineering Kabushiki Kaisha, Sagamihara (JP)

( * ) Notice: Subject to any disclaimer, the term of this patent is extended or adjusted under 35 U.S.C. 154(b) by 264 days.

(21) Appl. No.: 09/686,950

(22) Filed: Oct. 12, 2000

(30) Foreign Application Priority Data

Oct. 12, 1999 (JP) ..... P11-289514
Dec. 27, 1999 (JP) ..... P11-370863

(51) Int. Cl.[7] ..... B41J 2/045; B41J 2/14
(52) U.S. Cl. ..... 347/68; 347/47
(58) Field of Search ..... 347/68, 47, 70–72

(56) References Cited

FOREIGN PATENT DOCUMENTS

| | | | |
|---|---|---|---|
| EP | 0 803 918 A1 * | 10/1997 | ..... B41J/2/045 |
| JP | 6-40030 | 2/1994 | |
| JP | 8-238763 | 9/1996 | |

* cited by examiner

*Primary Examiner*—Judy Nguyen
(74) *Attorney, Agent, or Firm*—Armstrong, Westerman & Hattori, LLP

(57) ABSTRACT

There is provided an ink jet head to transmit a shock wave propagated by an oscillator plate to the ink discharge orifice without significant power-loss for ink ejection. An ink jet head has a body (10) having an oscillator plate with an outer surface (11) and an inner surface (12), the inner surface being parallel to the outer surface. The ink jet head also has an ink pressuring chamber formed in the body between the inner surface and an opposed lower wall (13), the lower wall being angled relative to the inner surface. The ink jet head also has an ink feed chamber formed in the body. The ink jet head also has an ink feed passage formed in the body communicating between the ink feed chamber and the ink pressuring chamber, the ink feed passage having an ink feed orifice opening into the ink pressuring chambers. The ink jet head also has an ink discharge passage formed through the lower wall of the body communicating with a discharge orifice on the lower wall, the ink discharge passage having an inlet at the ink pressuring chamber and terminating at the discharge orifice, the ink discharge passage being continuously narrowed from the ink pressuring chamber to the discharge orifice.

19 Claims, 13 Drawing Sheets

INK JET HEAD FOR USE IN A PRINTER

BACKGROUND OF THE INVENTION

1. Field of the Invention

The present invention relates to an ink jet head for use in a printer and particularly, to a head for transferring ink to an ink discharge orifice while minimizing loss of a discharging pressure applied to the ink, an inject head for feeding ink without being affected by the pressure for ejection of the ink and minimizing the blockage with the ink, and a technique for forming such a head through sintering a ceramic or glass assembly.

The present invention also relates to a structure of a driver with a piezoelectric/electrostrictive element for use with such an ink jet head and a method of fabricating the same.

The present invention relates to an ink discharge opening provided in such an ink jet head.

2. Introduction to the Invention

Ink jet printers have widely been used as computer output devices. The ink jet printers are small in the overall size and low in the cost while reproducing high-quality printed images.

One of the key technologies of ink jet printers is a head. The action of a common ink jet head includes applying a pressure in a pressurizing chamber where a liquid ink for printing is stored and ejecting the ink in the form of droplets from a discharge orifice onto printing paper. Means for applying the pressure are mainly the displacement of a piezoelectric element and the pressurizing in an ink chamber by generation of tiny air bubbles with the use of a heater for ejection of ink. The former exhibits less consumption of power and thus is favorable for further reducing the overall dimensions.

Characteristic examples of the former model are disclosed in Japanese Patent Laid-open Publications (Heisei)6-40030 and (Heisei)8-238763.

As shown in FIGS. 18 and 19, a technique disclosed in Publication (Heisei)6-40030 has an ink orifice member 102 made of a plurality of layers joined to one over the other and provided with an ink discharge orifice 100 which is communicated at the rear to an ink pressurizing chamber 104. The ink pressurizing chamber 104 is defined by an ink pump member 112 which comprises a joint plate 108 having an opening 106 provided therein for communication and a spacer plate 110 which both are made of green layers of a ceramic material joined to one over the other and sintered together to form a solid and a closure plate 114 bonded to the back of the ink pump member 112.

A piezoelectric/electrostrictive element and a pair of electrodes are disposed on the outer surface of the closure plate 114. More particularly, the piezoelectric/electrostrictive element 146 is sandwiched between the lower electrode 114 and the upper electrode 142. Denoted by 116 is an ink feed chamber for feeding ink via an ink feed orifice 118 and the opening 120 to the pressurizing chamber 104. In that arrangement, the pressurizing chamber 104 is provided in the ceramic solid and exhibits higher sealing effects. However, the ink orifice member 102 comprises an ink discharge orifice plate 122 and an ink feed orifice plate 124 joined by a passage plate 126 to each other using an adhesive. The ink orifice member 102 is then bonded by the adhesive to the ink pump member 112. Accordingly, the sealing between the plates is not perfect and may thus cause leakage of the ink. Also, the ink discharge orifice plate 122 is made of a metallic material. Even if the bonding between the plates of different materials is negligible, the metallic material is clearly limited by a stress generated during drilling of the nozzle on decreasing the distance between openings and may hence interrupt the higher density processing.

A shock wave generated by the closure plate 114 is propagated throughout the ink and reflected on the plate 108 arranged in parallel with the oscillating closure plate 114, thus creating interference and diminishing its pressing force. The ink discharge orifice is designed to sharply become narrower towards the opening and may develop reflection of the shock wave thus declining the pressure.

FIG. 20 is a cross sectional view of an ink head disclosed in Publication (Heisei)8-238763. The ink head has an ink pump member 112 fabricated by a set of a closure plate 114, a spacer plate 110, an ink feed orifice plate 124, and a reinforcement plate 123 of a ceramic material joined and sintered to a solid form which is thus improved in the sealing effect as compared with the previous ink head disclosed in (Heisei)6-40030. However, the ink pump member 112 is not bonded by an adhesive to a passage plate 126 and an ink discharge orifice plate 122, hence being unfavorable in the sealing effect. As apparent, the conventional head fails to have a specific structure for propagating the shock wave to the nozzle without loss to effectively transfer the pressure for efficient ejection of ink.

The ink head shown in FIG. 18 has the ink feed orifice 118 arranged facing the closure plate 114 and thus receiving directly the shock wave, whereby the feed of ink will be disturbed. The ink in a common ink jet head of a printer is pressurized for producing a high-speed jet by the piezoelectric/electrostrictive action of a piezoelectric element. The pressure generated is propagated as a shock wave throughout the ink. When the shock wave runs in its forward direction and is reflected on the opposite wall of the ink pressurizing chamber, its reflection now moves in the opposite direction and thus interferes with the coming shock wave running in its forward direction, hence diminishing the pressing force and declining the ejection of the ink from the discharge orifice. As the pressurizing chamber of a conventional ink jet head in a printer has its bottom wall arranged in parallel with the oscillating side of the piezoelectric element, the shock wave from the oscillating side is propagated through the ink and reflected on the bottom wall to offset its pressing force thus decline the effectiveness of propagation of the pressure. Also, as the ink discharge orifice 100 is provided in a conical shape becoming narrower towards the opening, the shock wave creates more reflections on the inner wall of the conical orifice 100 and offsetting its energy. Such a conventional structure fails to avoid loss of the shock wave and decrease loss of the pressure.

While the ink heads are critically demanded for minimizing the overall dimensions and speeding up the ejection of ink, the shock wave has to be generated at higher frequency and its waveform will be acute. Its propagation hence depends largely on the shape of not only the pressurizing chamber but also the ink discharge orifice 100 which has to be carefully designed for not diminishing the energy of the shock wave. Both the ink heads shown in FIGS. 18 and 19 are unsuccessfully designed where the ink discharge orifice 100 becomes narrower towards the tip or the opening. This only contributes to the accumulation of ink to be discharged according to the Bernoulli theorem. If the ink is dried and solidified in the ink discharge orifice close to the ink pressurizing chamber during the printing action, its solids having a greater size than the diameter of the ink discharge orifice may be trapped thus blocking up the orifice.

The ink pressurizing chamber 104 is squared at each corner and may often trap air bubbles of which the elasticity diminishes the energy of the pressure. Also, as the ink jet heads are located in an array close to each other, the action of one may possibly be affected by the action of another.

The ink feed orifice 118 is also located to face against the forward direction of the shock wave and its ink feeding action may be interrupted by the shock wave. If the ink is dried while being in the stand-by state before the printing, its solids will hardly be removed. The oscillating action of one ink jet head may affect the action of another. It is however essential for every ink jet printer producing high density prints without reducing the printing speed to have a higher density type of the ink jet head. For the higher density action, the conventional heads are arranged with the ink discharge orifice provided in a metallic plate for minute piercing. However, such a piercing technique is limited to the diffusion of the stress created and the size of a jig employed and may hardly be suited for the high density processing.

The piezoelectric/electrostrictive element used as a driving source for ejection of the ink with the ink jet head is also not favorable in the efficiency. It is known that when the element is exposed to an electric field of a coercive level which develops in parallel with the direction of polarization of the element, it expands along the direction of the electric field and the polarization and retracts along a direction at a right angle to the direction. Also, when the electric field is reversed to develop opposite to the direction of the polarization, the element retracts along the direction and expands along a direction at a right angle to the direction. The (Poisson's) ratio $\sigma$ of displacement along the direction at a right angle to the polarization direction to displacement along the direction of the polarization and the electric field is substantially up to 0.3 when the element is of a perovskite ceramic piezoelectric type such as using barium titanate. The ratio of displacement may not be very different in both the retraction and the expansion from that of a common PZT piezoelectric element made of a ceramic solid solution of $PbZrO_3$ and $PbTiO_3$.

The piezoelectric/electrostrictive element is generally located on the back of the ink jet head behind the ink pressurizing chamber and its oscillation energy is first transmitted to the wall of the ink pressurizing chamber which is thus oscillated to eject the ink.

FIG. 18 illustrates an example of the conventional ink jet head having a piezoelectric/electrostrictive element 146 located as a driver between an upper electrode 142 and a lower electrode 144 on the oscillator plate or closure plate 114 thereof.

When the voltage is applied between the lower electrode 144 at the positive and the upper electrode 142 at the negative, the electric field is developed upwardly. As the piezoelectric/electrostrictive element 146 is lengthwisely expanded and crosswisely retracted by the action of the electric field, its crosswise retracting movement of the element 146 is used for deflecting the oscillator plate 114 downwardly. When the ink pressurizing chamber 104 is pressed down, its ink discharge orifice 100 ejects a droplet of the ink. When not energized, the oscillator plate 114 remains in its horizontal state thus allowing the ink to be fed from the ink feed chamber 116 via the ink feed orifice 118 into the ink pressurizing chamber 104. In the conventional head, the oscillator plate or the closure plate 114 is deflected downwardly by the crosswise retracting movement of the element. As described above, the crosswise displacement is about ⅓ the lengthwise displacement and its efficiency will be low.

An ink jet head for an ink jet printer employing a bi-morphous type piezoelectric/electrostrictive element is disclosed in Publication (Heisei)8-118663 where the piezoelectric/electrostrictive element has a pair of PZT materials, which are opposite in the polarization to each other, sandwiched between two electrodes for increasing the electric distortion of the piezoelectric material.

In the above disclosed head, as best shown in FIG. 21, the bi-morphous type piezoelectric element 134 comprises a pair of piezoelectric/electrostrictive (PZT) elements 138 and 140, which are bonded to two, front and back, sides of an electrode member 136 and of which the directions of polarization are opposite to each other and orthogonal to the electrode surface, and a pair of driver electrodes 142 and 144 located on both sides of the paired elements and is located on an oscillator plate 132 made of a glass substrate 128 covered with a metallic layer 130 as above an ink pressurizing chamber 104. The paired piezoelectric/electrostrictive elements are thus opposite in the direction of electric distortion. For example, when the lower element expands, the upper element retracts.

Accordingly, the paired piezoelectric/electrostrictive elements exhibit electric distortion equal to a sum of the expansion of the lower element and the retraction of the upper element and its generating energy for ejection of the ink is greater than the uni-morphous type piezoelectric/electrostrictive element. As the direction of polarization in this case is yet in parallel with the direction of the electric field, the crosswise displacement of the piezoelectric/electrostrictive elements only is utilized and its efficiency will remain low. Unfortunately, the bi-morphous structure is more elaborate than the uni-morphous structure. It is also lower in the high-speed driving action than the uni-morphous structure.

The conventional uni-morphous type piezoelectric/electrostrictive driver allows the direction of polarization of the piezoelectric/electrostrictive element to is in parallel with the direction of the electric field and utilizes the displacement orthogonal to the direction. The displacement is as low in the efficiency as about ⅓ the displacement generated by the combined effect of the electric field and the polarization. While the bi-morphous structure exhibits a greater displacement than the uni-morphous structure, it is more elaborate in the arrangement. As the displacement in the direction orthogonal the direction of the electric field and the polarization is identical to that of the uni-morphous structure, its efficiency will remain low. Above all, the bi-morphous structure is unfavorable for the high-speed driving action.

The other major requirement for the ink jet head is the generation of a droplet of ink favorably controlled in the size, the timing, and the location. Most ink jet printers drive the piezoelectric/electrostrictive element to deflect the oscillator plate towards the ink pressurizing chamber and eject a droplet of the ink from its outlet. Before ejected out from an ink discharge opening 154, the ink travels in the form of a cylindrical column shape to the ink discharge orifice 100 (FIG. 23). Upon the oscillator plate returning back to the original position, the ink chamber is negatively pressurized. This causes the column of the ink to be separated into a drop let for printing down on paper and the rest which is then drawn back. At the time, some of the ink may possibly remain about the ink discharge opening 154 as denoted at 156. The lower side of the head about the ink discharge opening 154 is flat and may easily hold the remaining ink 156 which drops down in a mist together with the droplet and accumulates about a dot of print made of the droplet. The remaining ink 156 about the ink discharge opening 154 depends on the shape of the ink pressurizing chamber and the discharge orifice, the pressure in the ink pressurizing chamber, and the timing of de-pressurization. For minimizing the remaining ink, the designing of the shape and a control system for the oscillating action may undesirably be limited.

In addition, the separation of a droplet from the cylindrical column of ink forced by the oscillation of the oscillator plate 132 to run through the ink discharge opening 154 shown in FIG. 22 may significantly be controlled by the frequency and the amplitude of the oscillation. When the oscillation is uniform, the viscosity, the surface tension, the affinity to the contact surface of an inner wall of the ink discharge orifice, and other properties of the ink may also affect the separation. For example, since the ink is a non-Newton fluid, the stroke, speed, and timing of its traveling as the cylindrical column through the ink discharge opening 154 can not perfectly match the oscillation of the oscillator plate. The degree of matching may vary depending on the types of the ink. The viscosity of a commonly used ink for ink jet printing ranges from 0.7 cp to 20 cp.

The surface tension may vary depending on the type and the amount of a coloring agent, the presence or absence, the type, and the amount of a surface-active agent for stabilizing the dispersion of the coloring agent, the type and the amount of an ink solvent, and so on. For example, if the surface-active agent is used abundant for decreasing the surface tension, it may result in the blotting of the ink on paper. Although the surface-active agent is used not abundant, the surface tension of a commonly used ink for ink jet printing is as low as ranging substantially from 10 dyne/cm to 100 dyne/cm at 25° C. The materials of the conventional ink jet heads are commonly metallic or ceramic materials. The metallic materials and the ceramic materials are high in the free energy on surface. When the material comes into direct contact with the ink, its free energy on the surface may greatly be changed thus exhibiting higher wet affinity with the ink.

This causes the print of a letter or a line particularly in monochrome printing to appear blur at the edge, as the ink is blown out in a mist. In color printing, resultant color may be tanned.

Also, disclosed in Publication (Heisei)8-238763 is an ink jet head comprising an ink pressurizing chamber 104 provided on the back with an oscillator plate 132 which is oscillated by a piezoelectric driver having a piezoelectric element 146 sandwiched between two electrodes 142 and 144, an ink feed outlet 150 for feeding ink from an ink feed chamber 116 to the ink pressurizing chamber 104, and an ink discharge orifice 100 for ejecting the ink from the ink pressurizing chamber 104.

This ink head allows the piezoelectric driver 148 to drive and deflect the oscillator plate 132 toward the ink pressurizing chamber 104 and apply a pressure into the ink pressurizing chamber 104 which in turn ejects the ink from the ink discharge orifice 100. Upon the oscillator 132 returning back to its original, the ink pressurizing chamber 104 draws a fresh supply of the ink from the ink feed chamber 116 and simultaneously takes back the rest of the ink from an ink discharge opening 154. The lower side of the head about the ink discharge opening 154 is flat and, as shown in FIG. 23, may possibly hold the remaining of the ink 3 which drops down in a mist. Also, during the piercing process for the ink discharge opening 154, burs may be developed about the ink discharge opening 154. Such burs are hardly uniform and may assist the remaining of the ink to stay about the opening and fail to prevent the ink from dropping down in a mist. Accordingly, the remaining of the ink about the opening will hardly be avoided. In addition, as a number of the heads are commonly used in a printer, their ink jet actions may be varied by the above artifacts and fail to produce uniform droplets of the ink.

SUMMARY OF THE INVENTION

It is thus an object of the present invention, in view of the above aspects of the prior art, to provide an ink jet head which comprises an ink chamber, an ink discharge passage, and an ink discharge orifice arranged in an integral assembly of ink head material layers exhibiting higher sealing effects and having no steps or undulation in the inner wall which may interrupt the propagation of a shock wave thus to transfer the pressure for discharge applied to the ink to the ink discharge opening at optimum efficiency, as well as comprising an ink feed passage and an ink feed orifice for smooth feeding of the ink, whereby blockage with the ink will be minimized and interference with neighbor heads arranged in an array will be avoided. Its another object is to provide a method of fabricating the ink jet head.

It is a further object of the present invention, in view of the above aspects of the prior art, to provide an ink jet head equipped with an ink jet driver having a uni-morphous type piezoelectric/electrostrictive element which is highly efficient with an applied electric field, simple in the construction, and adapted for high-speed driving action.

It is a still further object of the present invention, in view of the above aspects of the prior art, to provide an ink jet head which can prevent ink from creeping around and remaining about the ink discharge opening on the lower paper side of the head during the ejection of the ink and thus dropping down in a mist and can eliminate generation of burs about the ink discharge opening to produce uniform droplets of the ink consistently and thus improve the quality of printed letters and images and to provide a method of forming the ink discharge opening in a ceramic or metallic material.

The above objects can be achieved by:

(1) an ink jet head for applying a voltage to a piezoelectric element located on at least one side of an ink pressurizing chamber thus to actuate an ink jet driver, which includes a piezoelectric/electrostrictive member having a piezoelectric/electrostrictive element combined with a lower electrode plate, for pressing and ejecting ink in the form of droplets from the ink discharge opening of an ink discharge orifice, said ink pressurizing chamber communicated with the ink discharge orifice and an ink feed orifice which communicates via an ink feed passage to an ink feed chamber, wherein an ink discharge passage extending from the ink pressurizing chamber to the ink discharge orifice is continuously varied in the size of the cross section;

(2) an ink jet head defined in the paragraph (1), wherein the ink jet driver comprises a uni-morphous type piezoelectric/electrostrictive member, which has an upper electrode plate, a piezoelectric/electrostrictive element, and a lower electrode plate arranged one over the other, located on at least one side of an oscillator plate of a metallic or ceramic material, and the polarization of the piezoelectric/electrostrictive element is at an angle to the surfaces of the electrodes;

(3) an ink jet head defined in the paragraph (1), wherein the tip of the ink jet orifice projects uniformly to a height of not smaller than one micrometer;

(4) an ink jet head defined in the paragraph (1), wherein the ink feed orifice and the ink feed passage communicating from the ink feed orifice become wider in the cross section towards the ink feed chamber, the ink feed passage between the ink pressurizing chamber and the ink feed chamber is bent at least once, and the ink feed orifice is arranged not to face the forward direction of the shock wave propagated from the piezoelectric element across the ink throughout the ink pressurizing chamber;

(5) an ink jet head defined in the paragraph (1), wherein the ink jet driver comprises a uni-morphous type piezoelectric/electrostrictive member, which has an upper electrode plate, a piezoelectric/electrostrictive element, and a lower electrode plate arranged one over the other, located on at least one side of an oscillator plate of a metallic or ceramic material, and when a voltage is applied between the upper electrode and the lower electrode at different, positive and negative, polarities, the piezoelectric/electrostrictive member is deflected in two, upward and downward, directions from its original horizontal position at the non-application of voltage;

(6) an ink jet head defined in the paragraph (1), wherein the ink jet driver comprises a uni-morphous type piezoelectric/electrostrictive member, which has an upper electrode plate, a piezoelectric/electrostrictive element, and a lower electrode plate arranged one over the other, located on at least one side of an oscillator plate of a metallic or ceramic material, and when a voltage is applied between the upper electrode and the lower electrode at different, positive and negative, polarities, the piezoelectric/electrostrictive member is deflected in two, upward and downward, directions from its original horizontal position at the non-application of voltage so that the ink pressurizing chamber is pressurized by the downward deflection and de-pressurized by the upward deflection thus to perform an ejection and a drawing of the ink respectively;

(7) an ink jet head defined in the paragraph (1), wherein the tip of the ink jet orifice projects uniformly to a height of not smaller than one micrometer and also a recess having a depth of not smaller than one micrometer is provided about the ink discharge opening in the lower paper side of the head;

(8) an ink jet head defined in the paragraph (1), wherein the ink jet driver has a ratio, tp/ts, of the thickness tp of the piezoelectric/electrostrictive element to the thickness ts of the oscillator plate is within a range from 0.3 to 0.7; and (9) a method of fabricating an ink jet head characterized by punching a ceramic material placed over a material, which is higher in the plastic deformation than the ceramic material, to form a projection and a recess about the opening on the ceramic material and after the punching process, sintering the ceramic material to remove the material placed below the ceramic material.

The present invention also covers:

(10) an ink jet head defined in the paragraph (1), wherein the inner wall of the ink discharge passage communicated to the ink discharge orifice is as smooth as not to have undulations for developing reflections of the shock wave in a reverse of the forward direction;

(11) an ink jet head defined in the paragraph (1) or (10), wherein the piezoelectric element remains supplied with a voltage, which is smaller than that for the printing action, for oscillating the ink during the non-printing mode;

(12) an ink jet head defined in any of the paragraphs (1), (10), and (11), wherein $L \leqq M \leqq 4/3L$ is established assuming that L is the minimum diameter of the cross section in the ink discharge passage extending from the ink chamber to the ink discharge orifice or at the ink discharge orifice and M is the inner diameter of the tip of the ink discharge orifice; and

(13) an ink jet head defined in any of the paragraphs (1), (10), (11), and (12), wherein the ceramic material is made by forming layers of ceramic or glass paste one over the other in corresponding molds of not smaller than 5 micrometers in depth and sintering the layers together.

The present invention also covers:

(14) an ink jet head defined in the paragraph (4), wherein the ink feed orifice and the ink feed passage for communicating the ink feed chamber with the ink pressurizing chamber are arranged becoming wider in the cross section from the ink pressurizing chamber towards the ink feed chamber, the ink feed passage is bent at least once between the ink feed chamber and the ink pressurizing chamber, and the ink feed orifice is arranged not to face the forward direction of the shock wave propagated from the piezoelectric element across the ink throughout the ink pressurizing chamber;

(15) an ink jet head defined in the paragraph (14), wherein the ink pressurizing chamber is arranged to have a curved surface of not smaller than 5 micrometers in radius at each corner where two orthogonal walls meet each other;

(16) an ink jet head defined in the paragraph (14) or (15), wherein the ink pressurizing chamber has a wall thereof opposite to the piezoelectric element arranged not to face the forward direction of the shock wave generated by the piezoelectric element and propagated across the ink throughout the ink pressurizing chamber;

(17) an ink jet head defined in any of the paragraphs (14) to (16), wherein a slit is provided in the partition of an ink pressurizing chamber block between any two adjacent ink jet heads in the array; and

(18) an ink jet head defined in any of the paragraphs (14) to (17), wherein the ceramic material is made by forming layers of ceramic or glass paste one over the other in corresponding molds of not smaller than 5 micrometers in depth and sintering the layers together.

DETAILED DESCRIPTION OF THE INVENTION

The features of the present invention is now explained in more detail.

The pressure applied to the ink by the oscillator plate of the piezoelectric element is propagated as a shock wave and reflections of the shock wave on the inner walls of the ink pressurizing chamber may interfere with the coming shock wave. As the inner walls of the ink pressurizing chamber are arranged not to face directly the forward direction of the shock wave according to the present invention, such wave interference can be avoided and the pressure can be transmitted to the ink discharge orifice without significant loss for ejection of the ink. Also, as the cross section of the ink discharge passage is continuously varied from the ink chamber side to the ink discharge orifice, the pressure of the shock wave can be received by the ink discharge orifice without significant loss hence allowing dried portions of the ink generated during the standby mode to be ejected out without difficulty.

Meanwhile, for inhibiting the pressure of the ink from transmitting into the ink feed chamber, the cross section of the ink feed passage becomes wider from the ink pressurizing chamber towards the ink feed chamber and is bent at least once in the midway. The ink feed orifice is arranged not to face the forward direction of the shock wave. Also, any tow adjacent ink jet heads in an array are separated by the slits from each other for preventing interference. Moreover, the piezoelectric element remains impressed with a voltage, which is smaller than for the printing action, in the standby mode for weakly oscillating the ink to inhibit any drying out of the ink in the ink discharge passage the ink discharge orifice.

The ink jet head of the present invention is made by forming patterns of green paste or slurry of a ceramic or glass material in layers in corresponding molds by a manner similar to a known silk screen technique and subjecting a resultant layers assembly to the sintering. This eliminates various problems pertinent to the metal working in the prior art, such as diffusion of the stress generated during the piercing and the dimensions of jigs, hence decreasing the distance between any two openings in the head to as a small length as 2 micrometers.

Detailed Description of Illustrative Embodiment

For ease of understanding the present invention, embodiments of the present invention will be described in mode detail referring to the relevant drawings.

Figure 1:
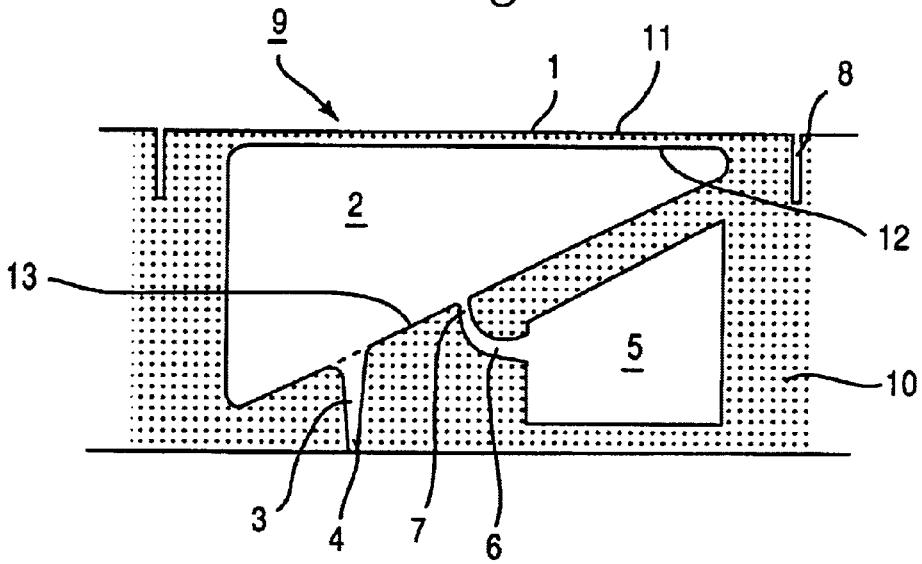
FIG. 1 is a cross sectional view of an ink jet head for a printer showing one embodiment of the present invention.
Figure 2:
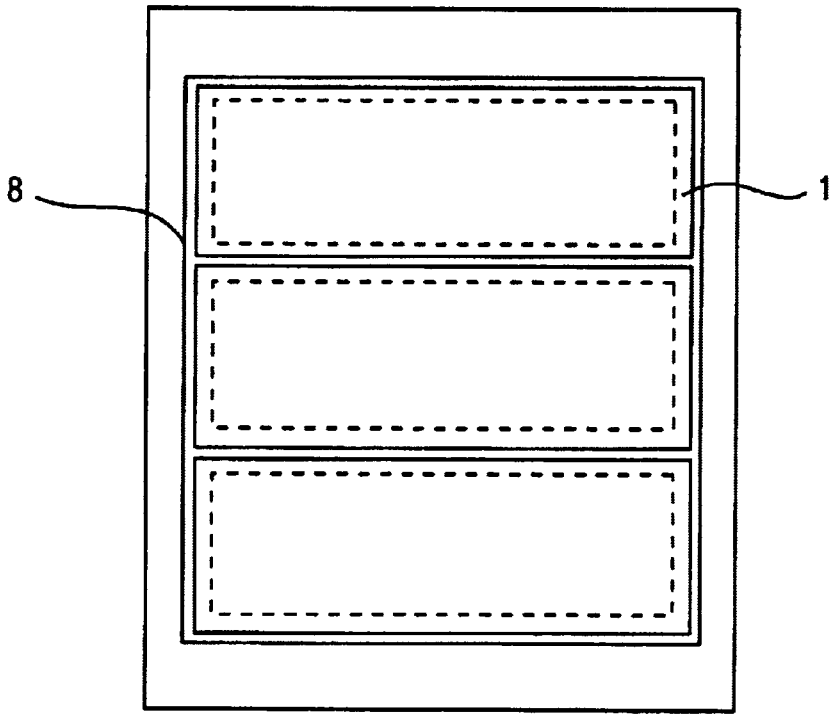
FIG. 2 is a plan view of the ink jet head for a printer of FIG. 1 seen from the above.
Figure 3:
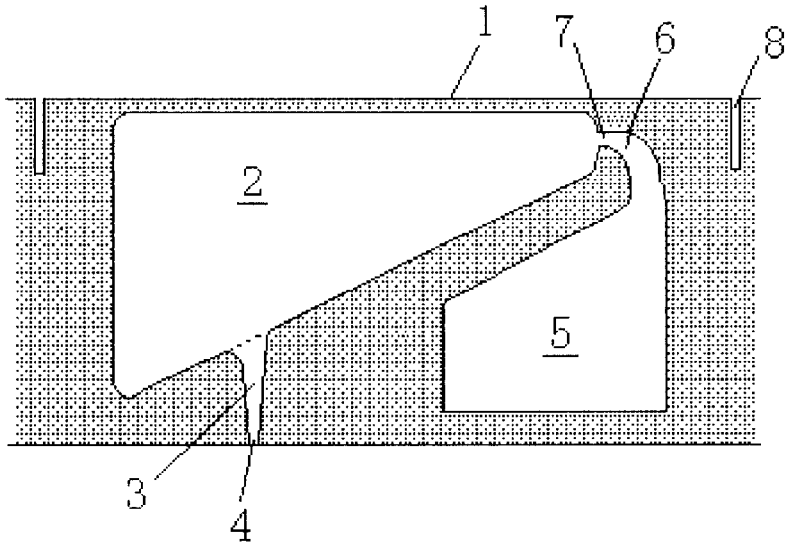
FIG. 3 is a cross sectional view of an ink jet head for a printer showing another embodiment of the present invention.

FIG. 1 is a cross sectional view of a head according to the present invention and FIG. 2 is a plan view of the same. FIG. 3 is a cross sectional view of another head according to the present invention. As shown in FIG. 1, ink supplied in an ink pressurizing chamber 2 of the head 9 is oscillated by the piezoelectric/electrostrictive action of a piezoelectric element located above the head 9 but not shown, increased in the volume in the ink pressurizing chamber 2, forced to an ink discharge passage 3 by the action of a pressure developed by an oscillator plate 1 in the pressurizing chamber 2, and finally discharged from a discharge orifice 4. In advance, the ink is supplied from an ink feed chamber 5 via an ink feed passage 6 and an ink feed orifice 7 to the ink pressurizing chamber 2. The pressure generated by the oscillator plate 1 is propagated as a shock wave throughout the ink which is thus forced through the discharge passage 3 and discharged from the discharge orifice 4 as a droplet. When the pressure in the ink pressurizing chamber 2 is negative, the pressurizing chamber 2 draws in from the ink feed chamber 5 through the ink feed passage 6 and the ink feed orifice 7. The oscillator plate 1 is oscillated up and down by the action of the piezoelectric element.

Figure 5:
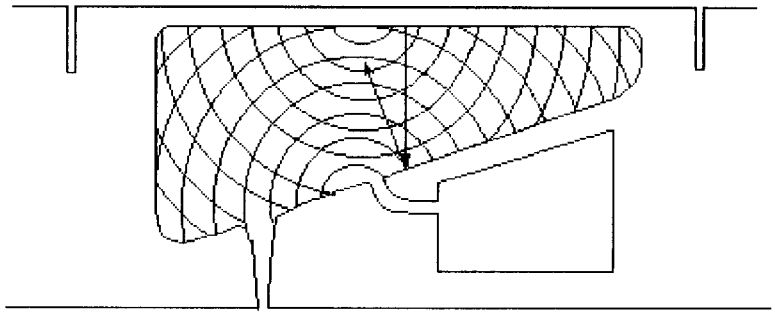
FIG. 5 is a schematic view showing the propagation of a shock wave in the ink jet head for a printer according to the present invention.

FIG. 5 schematically illustrates the shock wave generated by the oscillation of the oscillator plate 1 being propagated throughout the ink and reflected on the lower wall. As apparent, the propagation of the shock wave generated by the oscillator plate 1 is closely related to the construction of the head. According to the present invention, the lower wall of the ink pressurizing chamber 2 is not orthogonal but at an angle to the direction of propagation of the shock wave, hence avoiding the shock wave from being diminished by interference with its reflected components and permitting the pressure to be effectively propagated to the discharge orifice 4. In this embodiment, the lower wall is arranged, but not limited to, at an angle of 32 degrees for eliminating substantially 15% of the reflected wave.

Figure 4:
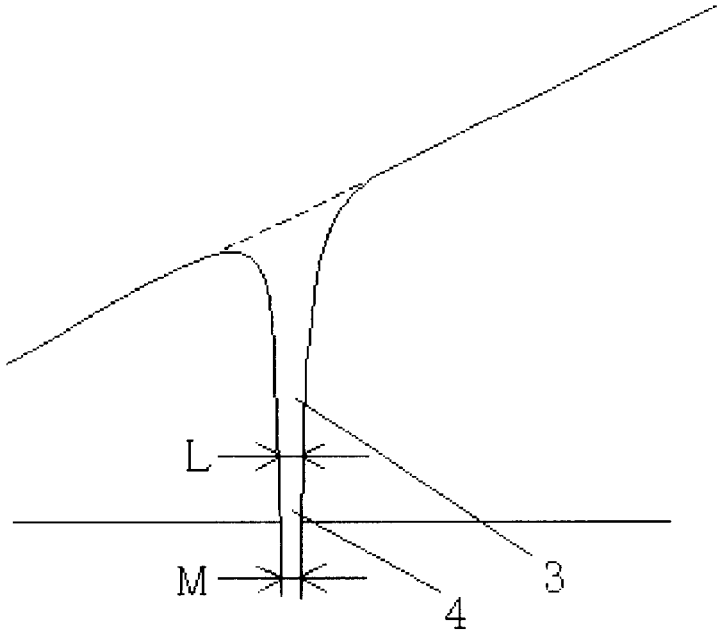
FIG. 4 is a cross sectional view illustrating an ink discharge passage and an ink discharge orifice in the ink jet head for a printer according to the present invention.

FIG. 4 is an enlarged cross sectional view showing the discharge passage 3 and the discharge orifice 4. As shown, the ink discharge passage 3 is continuously varied in the cross-sectional size. Assuming that the minimum diameter in the ink discharge passage 3 from the inlet to the outlet or the ink discharge orifice 4 and the diameter at the opening end of the discharge orifice 4 is M, $L \leqq M \leqq 4/3L$ is established. In action, the shock wave enters the inlet and propagates smoothly without any significant loss as carries the pressure to the ink discharge orifice 4. As expressed "continuously varied", the inner wall of the ink discharge passage 3 communicated to the ink discharge orifice 4 is smooth enough to have no reflective surfaces which may produce reflection of the shock wave to run in a reverse of the direction of the propagation. For example, when the shock wave is a sine wave, any undulation greater than ½ the wavelength is not developed on the inner wall.

The ink feed passage 6 and the ink feed orifice 7 for feeding the ink from the ink feed chamber 5 to the ink pressurizing chamber 2 both are gradually increased in the inner diameter from the ink pressurizing chamber 2 towards the ink feed chamber 5 for inhibiting the transfer of the pressure from the ink pressurizing chamber 2 to the ink feed chamber 5. The effect of inhibiting the propagation of the shock wave is improved by this embodiment of the present invention where the ink feed passage 6 is not straight but curved.

FIG. 3 illustrates a modification of the head where the outlet of the ink feed orifice 7 is provided at a far corner of the ink pressurizing chamber 2 so as not to be confronted with the propagation of the shock wave. It is very likely that air bubbles are inevitably generated in the ink pressurizing chamber 2 and may decline the inner pressure. Particularly, air bubbles may often be developed at each corner of the ink pressurizing chamber 4. For compensation, as best shown in FIG. 1, the ink head of this embodiment has the ink pressurizing chamber 4 rounded at each inside corner. The radius for rounding is about 5 μm or greater.

The ink head of the embodiment is preferably separated by a slit 8 from an adjacent ink head. The slit 8 may have a width of 1 to 2 μm and a depth of 5 to 10 μm. FIG. 2 is a plan view of a pattern of the slit 8 seen from the oscillator plate 1 side. The slit 8 prevents the oscillation of the oscillator plate 1 from adversely affecting the action of the ink jet head. Also, it may allows the oscillator plate 1 to be more accurately oscillated and to be maintained in a level of the strength at the edge. According to the present invention, the piezoelectric element remains energized with a voltage during the non-printing mode which is smaller than that in the printing mode. This causes the ink to continuously oscillate hence avoiding its undesired solidification in the ink discharge passage and the ink discharge orifice. The "smaller" voltage means not higher than 80% of the printing voltage and preferably not higher than 65 to 40% of the printing voltage and can be controlled by voltage drop, frequency decrease, and reduction of the voltage applying duration.

The ink jet head of the present invention having the above described arrangement is fabricated by preparing a desired number of planer molds placed one over the other at intervals of not smaller than 5 μm (a thickness), preferably 5 to 100 μm, and more preferably 10 to 100 1 to 2 μm, and filling the molds with layers of a green paste which consists mainly of a ceramic or glass slurry material doped with a binder using a doctor blade apparatus or a screen printing apparatus. As the layers have been deposited one over the other from the bottom of the molds, their assembly is sintered to a solid form. If the thickness is smaller than 5 μm, a resultant layer will be too thin to maintain the size of inner spaces which is highly susceptible to a very small pressure. On the contrary, when the thickness is greater than 100 μm or the number of layers is too large, a resultant layers assembly may be dried with difficulty and time and its dimensional accuracy will be wobbled.

Figure 6:
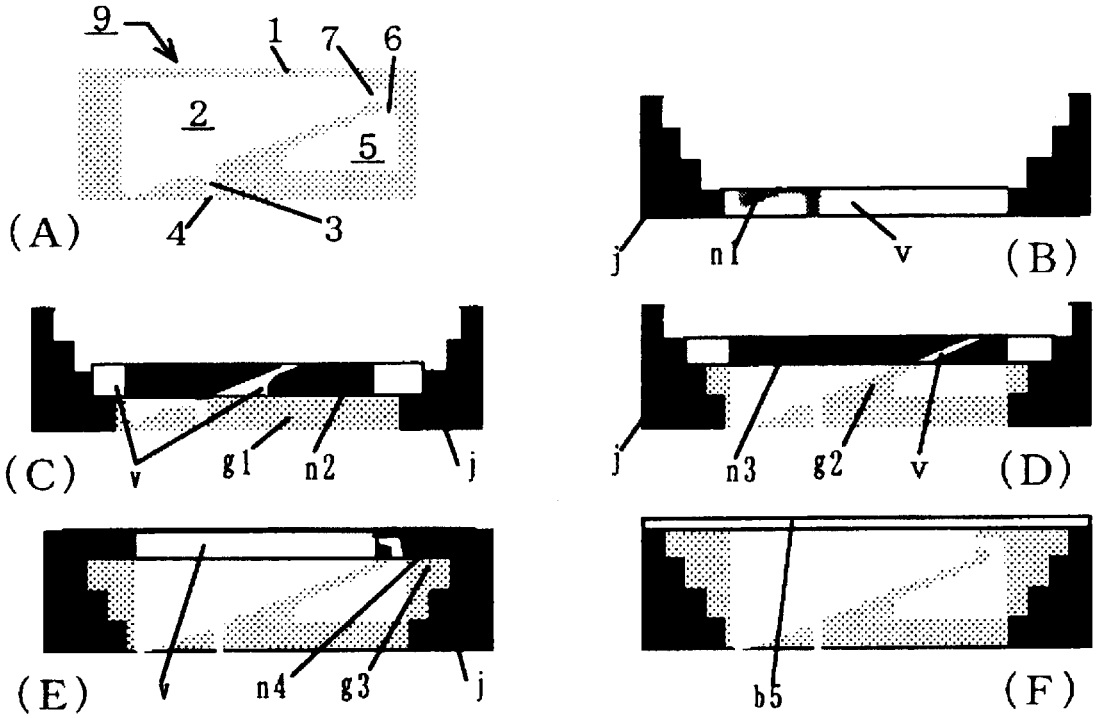
FIG. 6 is a view showing a basic procedure of fabrication according to the present invention.

As schematically shown in FIG. 6, a form of the ink jet head having the above arrangement (FIG. 6A) can be fabricated by filling with a paste material the first mold n1 having a particular shape of space v therein and installed in a mold positioning jig j (FIG. 6B), placing, after removal of the first mold n1, the second mold n2 having another pattern of space v over a self-sustained green paste material layer g1 and filling the second mold n2 with the paste material so carefully that it triggers no deformation of the green paste material layer g1 (FIG. 6C), placing, after removal of the second mold n2, the third mold n3 having a further pattern of space v over a self-sustained green paste material layer g2 and filling the third mold n3 with the paste material (FIG. 6D), repeating this action (FIG. 6E), placing and filling the final mold b5 with or directly printing the paste material for forming the oscillator plate (FIG. 6F), and finally sintering a finished layers assembly. The layers assembly made of the green paste material may possibly be shrunk more or less during the sintering and its dimensions should be determined with allowance.

The procedure shown in FIGS. 6A to 6F is an example of the fundamental method of the present invention. The method of the present invention may be modified using known layer depositing techniques. For example, since the mold positioning jig j is stepped for holding a group of the molds, the finished layers assembly is trimmed prior to the sintering. If the layers assembly of the paste material is highly self-sustained or locally dried for gaining the self-sustainability, the steps of the jig j may be eliminated. Alternatively, when the paste material exhibits a higher self-sustainability, the layers may be fabricated separately and bonded to one over the other in another step before subjected to the sintering. The plasticity and drying speed of the paste material may also be controlled favorably by adjusting the type and amount of a solvent employed (e.g. a different pressure of steam) and doping a viscosity modifier (e.g. an organic wax). Also, when the molds n1 to b5 are too flexible, they may be supported with appropriate supporting means at corresponding locations where a molded shape is not disturbed. For simplicity of the description, one single head is illustrated but two or more heads may be fabricated from an array of the molds. The method of the present invention may also be applied for fabricating the heads for either a line printer or a serial printer.

The ink jet head fabricated by the foregoing method has an ink feed chamber 5 communicated by an ink feed passage 6 and an ink feed orifice 7 with an ink pressurizing chamber 2. The top plate 1 above the ink pressurizing chamber 2 is linked with a piezoelectric element located above to act an oscillating diaphragm for applying pressure against the ink in the ink pressurizing chamber 2. The lower wall of the ink pressurizing chamber 2 is sloped but not in parallel with the oscillator plate 1 for inhibiting interference with the shock wave developed by the oscillator plate 1 and propagated throughout the ink. An ink discharge passage 3 and an ink discharge orifice 4 are provided in the lower wall. The center line of the discharge passage 3 and the discharge orifice 4 extends in the same direction of the propagation of the shock wave for allowing the shock wave to propagate effectively through the discharge passage 3.

The discharge passage 3 and the discharge orifice 4 have a circular size in the cross section and are continuously varied in the area of the cross section for minimizing the pressure loss and for assisting the escape of dried ink. The outlet of the ink feed orifice 7 is arranged not to face directly the direction of the propagation of the shock wave for avoiding the shock wave from entering the ink feed chamber 5.

The ink feed passage 6 is also increased in the area of the cross section from the ink pressurizing chamber 2 to the ink feed chamber 5 and adapted to bend at least one time. Each corner of the ink pressurizing chamber 2 and the inlet of the discharge passage 3 are rounded for smoothness. A slit 8 is provided about the ink pressurizing chamber 2 in the ink jet head for inhibiting interruption from an adjacent ink jet head and giving a level of flexibility to the partition.

Also, for avoiding blockage of the ink, the piezoelectric element remains energized in the non-printing mode with a voltage (a power) which is smaller than that in the printing mode for continuously oscillating the ink. The ink jet head having the above arrangement may preferably be fabricated by filling a group of planer molds joined to each other by intervals of not smaller than 5 $\mu$m with layers of a ceramic or glass material one by one and subjecting a finished layers assembly to sintering.

An ink jet driver for use in the ink jet heat of the present invention will be described.

The ink jet driver in the ink jet head of the present invention has a piezoelectric/electrostrictive element arranged with its orientation slanting against the electrode faces. This develops a uni-morphous structure which can efficiently create a force to deflect the oscillator plate up and down. More particularly, the polarization of the piezoelectric/electrostrictive element located together with a pair of upper and lower electrodes on one side of the oscillator plate is slanted against the electrode faces when an electric field is applied.

Figure 7:
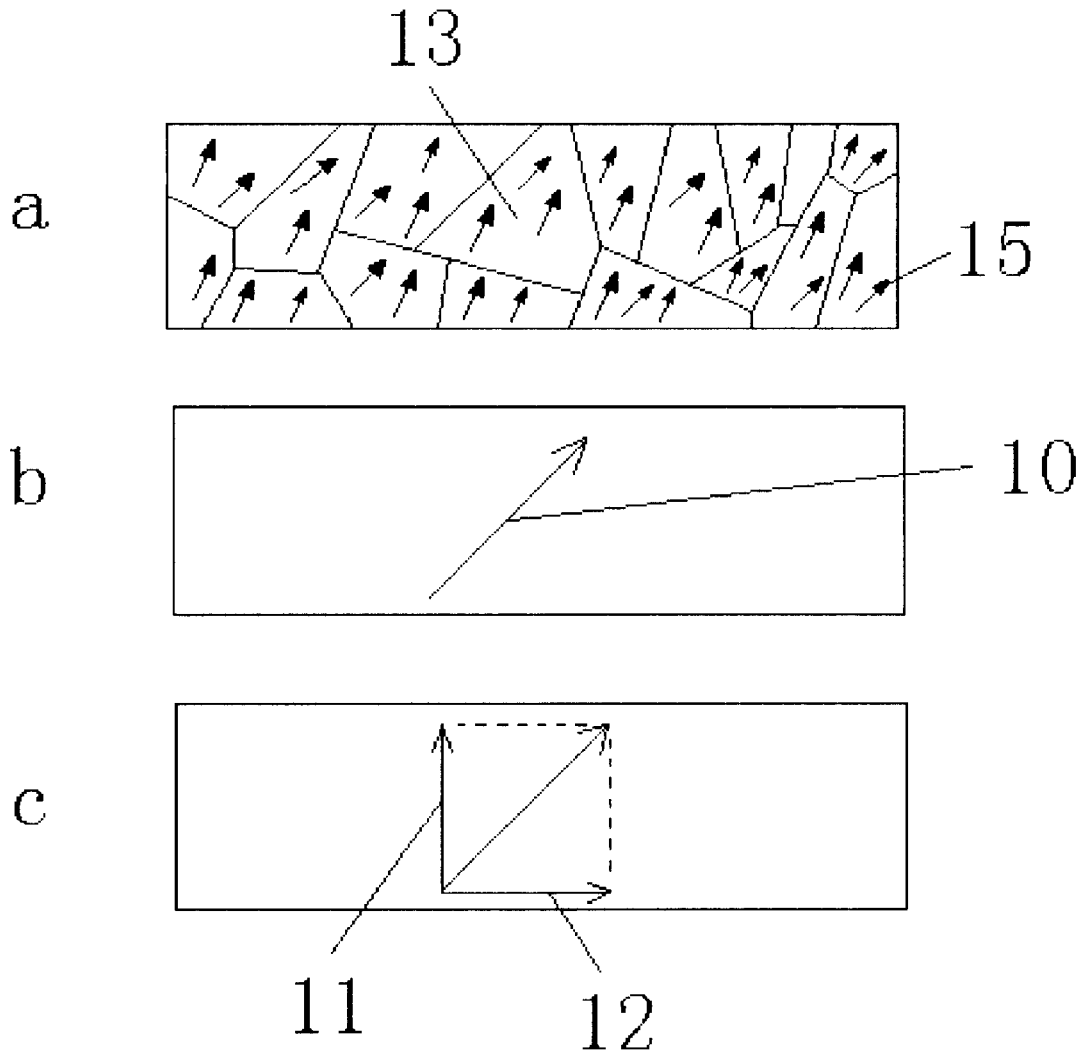
FIG. 7 is a diagram illustrating the direction of polarization in each grain, its average vector, and the same with a horizontal component and a vertical component in a piezoelectric/electrostrictive element according to the present invention.

As shown in FIG. 7*a*, the polarization of each grain of the piezoelectric/electrostrictive element according to the present invention is substantially slanted although some variations are allowed. The polarization may thus be expressed by a vector 10 shown in FIG. 7*b*. The vector of the polarization has a horizontal component 12 and a vertical component 11 as shown in FIG. 7*c*.

Figure 8:
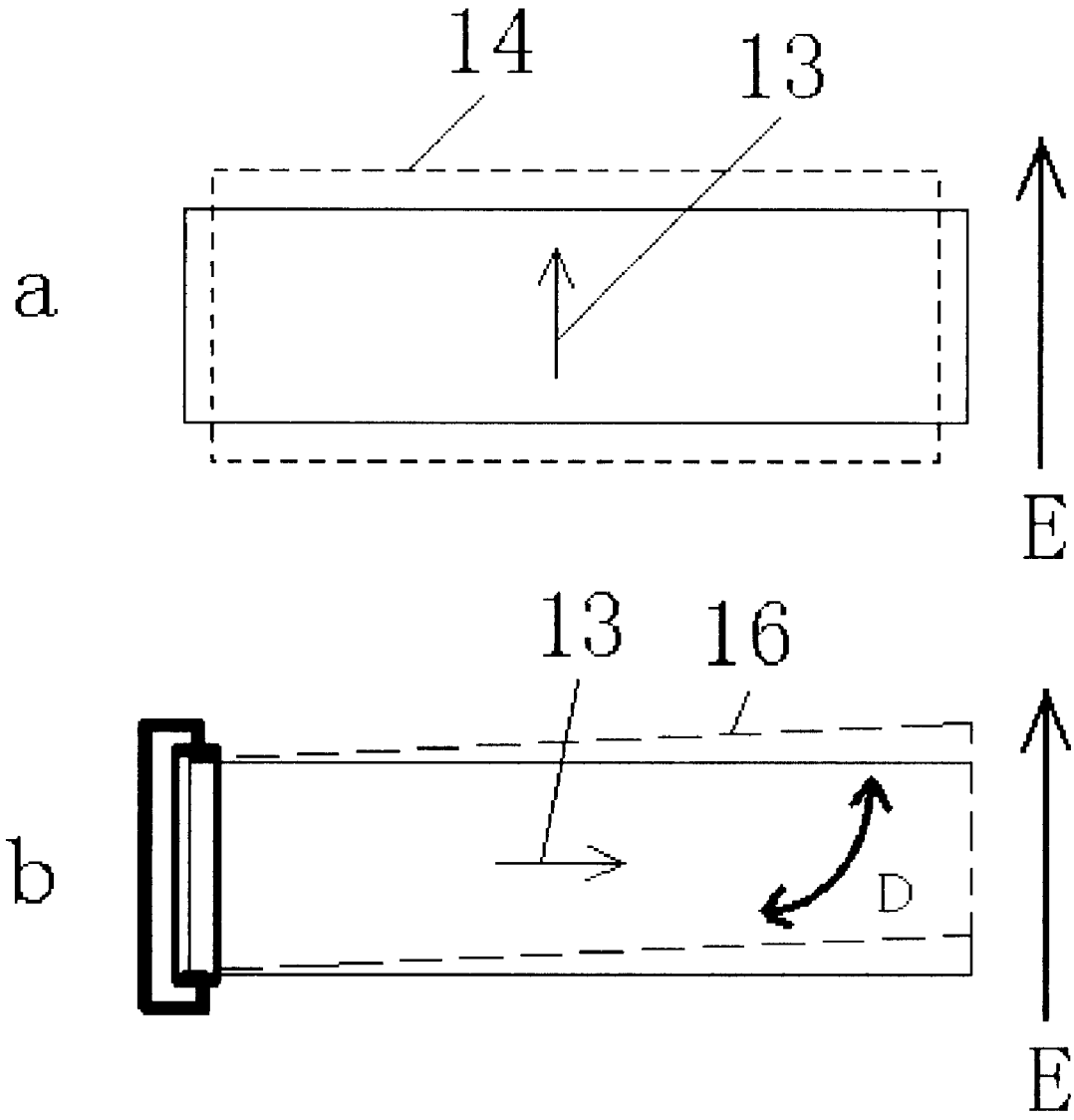
FIG. 8 is a diagram illustrating displacements of the piezoelectric/electrostrictive element with its slant polarization separated to a vertical component and a horizontal component by the interaction with an upward electric field E.

When the electric field E is applied in parallel with the polarization of the piezoelectric/electrostrictive element in the same direction, the piezoelectric/electrostrictive element may be deformed to a shape 14 or expanded in the vertical direction and retracted in the horizontal direction as shown in FIG. 8*a*. When the electric field E is applied in the opposite direction, the element may be retracted in the vertical direction and expanded in the horizontal direction. In case that the piezoelectric/electrostrictive element is of a typical uni-morphous type clamped at one end (with the fulcrum located at the leftmost end) as shown in FIG. 8*b*, it may be deflected upwardly to a shape 16 by application of the electric field E in the upward direction and vertical to the horizontal component of the polarization. The piezoelectric/electrostrictive element may be deflected downwardly when the electric field E is applied in the downward direction. This is explained by the fact that the direction of oscillation of the piezoelectric/electrostrictive element is substantially a diagonal direction (denoted by D in FIG. 8*b*). This phenomenon is equally encountered when the piezoelectric/electrostrictive element is clamped at both ends. In the latter case, the distance between a node and an anti-node in the oscillation is however ½. An equal theory is applicable when the number of clamps is increased.

Figure 9:
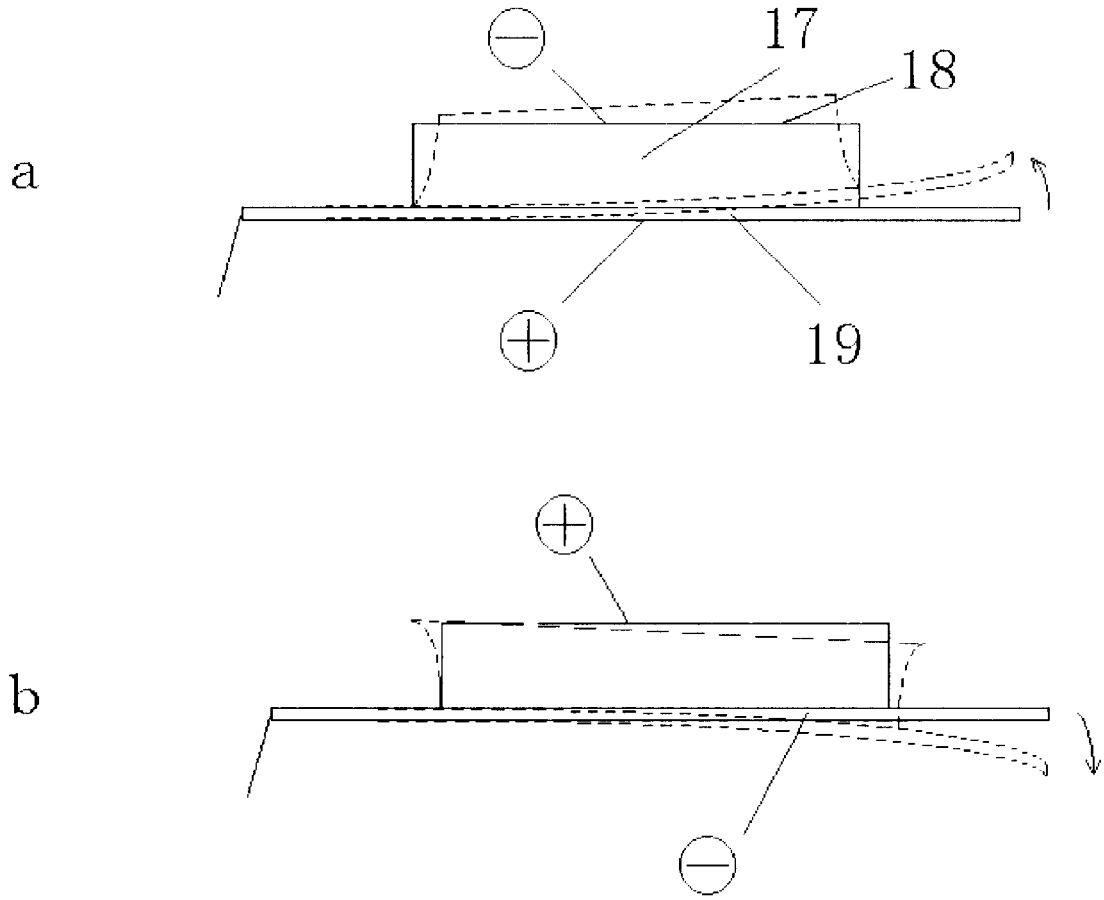
FIG. 9 is a view of the piezoelectric/electrostrictive element and the oscillator plate deflected when a voltage is applied between two, upper and lower, electrodes.

As the piezoelectric/electrostrictive element is slanted in the polarization, it can receive a sum of forces generated between the horizontal component of the polarization and the electric field and between the vertical component of the polarization and the electric field. FIG. 9 schematically illustrates the piezoelectric/electrostrictive element 17 of which the polarization is slanted and which is accompanied with an oscillator plate and two, upper and lower, electrodes as well as their deformation when a voltage is applied. The lower electrode 19 is incorporated with the oscillator plate of a metallic material. Referring to FIG. 9*a*, the element and the oscillator plate are deflected as denoted by the dotted line about one end or the fulcrum when the voltage is applied between the upper electrode 18 at the negative and the lower electrode 19 at the positive. Also, referring to FIG. 9*b*, the element and the oscillator plate are deflected downwardly as denoted by the dotted line when the voltage is reversed. As shown in FIG. 9, the oscillator is anchored at one end as the fulcrum. As is also presumed from FIG. 9, the oscillator plate anchored at both ends can deflect downwardly with the voltage of FIG. 9*a* and upwardly with the voltage of FIG. 9*b*. Accordingly, by changing the polarity of the voltage, the oscillator plate bonded to the element can successfully be deflected in alternating, upward and downward, directions. As compared with the uni-morphous structure, the cooperative action between the electric field and the horizontal component of the polarization can favorably be improved in this embodiment thus causing the oscillator plate to oscillate more efficiently.

Figure 10:
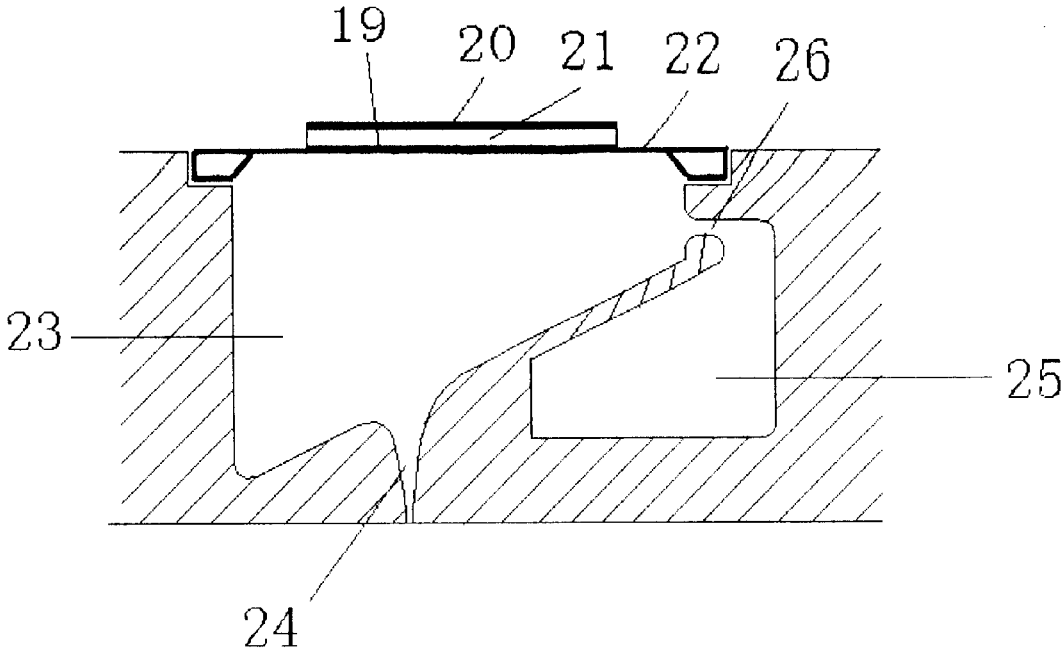
FIG. 10 is a cross sectional view of the ink jet head equipped with a uni-morphous type piezoelectric/electrostrictive element according to the present invention.

In practice, the ink jet head of the present invention having a uni-morphous type piezoelectric/electrostrictive driver shown in FIG. 10 can be fabricated by a known technique of exposing a polycrystal body such as a piezoelectric/electrostrictive element to the electric field to carry out polarization. More specifically, as the electric field applying to the polycrystal body is gradually intensified, it reaches a coercive electric field level. When the electric field is further intensified, the polarization in each grain starts inverting. As all possible grains are inverted in the polarization and aligned in the direction of the electric field, the polarization is established. The direction of the polarization may be determined by controlling the direction, the strength, and the duration of the electric filed to be applied. In this embodiment, the polarization 13 of each grain 15 is aligned at an angle of e.g. 45 degrees as shown in FIG. 7*a*.

Alternatively, the polycrystal structure of the piezoelectric/electrostrictive element can be tailored to have a diagonal pattern of the polarization by controlling the growth direction of crystals. In that case, the direction of the polarization on the piezoelectric/electrostrictive element may commonly be a reverse of the crystal growth direction in the polycrystal structure. Accordingly, the ink jet head of the present invention having a uni-morphous type piezoelectric/electrostrictive driver can be fabricated by a hydro-thermal synthetic method of first providing a plurality of small V grooves in the electrode substrate over which PZT crystals are deposited, placing the substrate in a tilted position, and growing crystals vertical to one of the two sloped walls of each V groove and thus at an angle to the substrate or by another known crystal depositing technique such as a CVD method or a sputtering method of first depositing crystalline cores vertically on the substrate disposed in a tilted position and thus at an angle to the substrate and then growing PZT crystals on the tilted crystalline cores. The deposition of crystalline core largely depends on surface energy over the crystalline deposition surface. As the substrate having a sloped facet activated is tilted so that its facet is perpendicular to the direction of depositing crystalline cores, the fabrication of the ink jet head of the present invention having a uni-morphous type piezoelectric/electrostrictive driver can highly be promoted.

FIG. 10 illustrates an example of the construction of the ink jet head of the present invention having a uni-morphous type piezoelectric/electrostrictive driver. The construction includes a piezoelectric/electrostrictive driver which comprises an upper electrode 20 located on one side of an oscillator plate 22, a lower electrode 19, and a piezoelectric/electrostrictive element 21 made of barium titanate, PZT, or the like assembled in a uni-morphous structure, and an ink housing provided below the piezoelectric/electrostrictive driver which comprises an ink pressurizing chamber 23, an ink feed chamber 25, an ink discharge orifice 24, and an ink feed orifice 26. When the voltage is applied between the lower electrode at the positive and the upper electrode at the negative and the piezoelectric/electrostrictive element 21 is exposed to an electric field E of a coercive level, the oscillator plate 22 deflects downwardly as described previously. On the contrary, when the voltage is applied between the upper electrode at the positive and the lower electrode at the negative, the oscillator plate 22 deflects upwardly. By alternating the polarity of the voltage between the upper and lower electrodes, the oscillator plate 22 can be deflected upwardly and downwardly at effectiveness. As the oscillator plate 22 is deflected downwardly, it applies a pressure against the ink pressurizing chamber 23 to eject ink out from the ink discharge orifice 24. When the oscillator plate 22 is deflected upwardly, its decreases the pressure in the pressurizing chamber 23 thus causing the ink to flow from the ink feed chamber 25 via the ink orifice 26 to the ink pressurizing chamber 23.

The oscillator plate 22 may be made of a ceramic material or a metallic material such as titanium. When the oscillator plate 22 is a metallic material, it may serve as the lower electrode. More specifically, a metal material may be coated with an insulating layer on which the electrode is deposited. When the plate is a metallic material such as titanium, it may be bonded to the ink pressurizing chamber body of a ceramic material by an adhesive. In that case, the oscillator plate 22 is folded down at both ends to improve the physical strength at the ends and increase the bonding strength as shown in FIG. 10.

Figure 11:
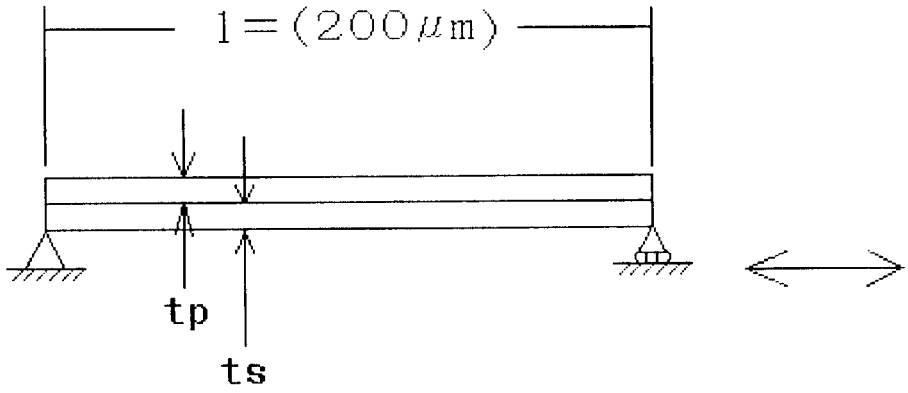
FIG. 11 is a diagram showing the piezoelectric/electrostrictive element and the oscillator plate at preferable thickness according to the present invention.

FIG. 11 illustrates an preferable relationship in thickness between the piezoelectric/electrostrictive element and the oscillator plate according to the present invention.

Assuming that the displacement $\delta$ of the oscillator plate is maximum when the piezoelectric/electrostrictive element is deflected by $\epsilon\ \alpha$, the ratio between the thickness tp of the piezoelectric/electrostrictive element and the thickness ts of the oscillator element is determined for having the maximum displacement. For measurement, the oscillator plate of 200 micrometers in length is supported at both ends on two supports which can be moved horizontally as shown in FIG. 11. It is found from the measurement that the displacement $\delta$ is maximum when the ratio tp/ts is 0.5. As the ratio is smaller or greater than 0.5, the displacement declines. Preferably, when the thickness tp of the piezoelectric/electrostrictive element is 1.5 micrometers, the thickness ts of the oscillator plate is 3 micrometers for exhibiting the maximum of the displacement $\delta$.

Also, related to the present invention are techniques for preventing the ink from remaining about the ink discharge opening during the ejection of the ink and splashing out over a sheet of printing paper and for eliminating adverse factors such as burrs at the discharge opening which may generate unwanted droplets of the ink.

According to the present invention, the ink jet head has a projection provided thereon about the ink discharge opening for smooth discharge of the ink. The height of the projection is so determined as not to permit any droplet of the ink to be discharged to be abundant enough to remain about the ink discharge opening. The abundance of the ink droplet depends largely on the diameter of the ink discharge opening. The diameter of the ink discharge opening depends on the diameter of a chisel or punch in the punching or the diameter of a laser beam spot in the laser drilling. In common use, the diameter ranges substantially from 5 $\mu$m to 30 $\mu$m. It is hence necessary to have the projection raised up to 5 $\mu$m for avoiding the abundance of the ink droplet to be discharged from the ink orifice having the above range of the diameter. The height of the projection however fails to account the generation of mist of the ink separated from the droplets at the discharge opening. Also, for matching the current demand for reproducing as a high definition, high quality image as 1200 dpi, the diameter of any ink droplet may be about 2 $\mu$m when its blotting on printing paper is negligible. When the blotting has critically to be avoided, the diameter is then as small as about 1 $\mu$m.

Simultaneously, an annular recess having a width of not smaller than 5 $\mu$m and preferably not smaller than 1 $\mu$m is provided about the ink discharge opening in the paper side of the ink jet head for avoiding the ink from remaining about the opening. While the projection and the recess are generally shaped by a known precision process technique, they can be sized by a more simple, precise technique according to the present invention. More specifically, while the head having the ink discharge opening therein is fabricated by depositing and sintering layers of a green ceramic material, a resin layer sized for the projection and the recess is deposited about the ink discharge opening under the layers of the green ceramic. Then, the ceramic layers and the resin layer are pieced at once with a punch lowering from the above. This punching action causes a portion of the ceramic layers to advance into the resin layer to form the projection about the ink discharge opening. As the resin layer has been evaporated during the sintering process, the shape of the projection and the recess shown in FIG. 11 is completed.

Also, the ink discharge opening may be provided in a metallic material. As the ink discharge opening is formed using a set of punch and die, it is subjected to coining. The coining is advantageous for precisely determining the size and shape of the ink discharge opening.

Figure 12:
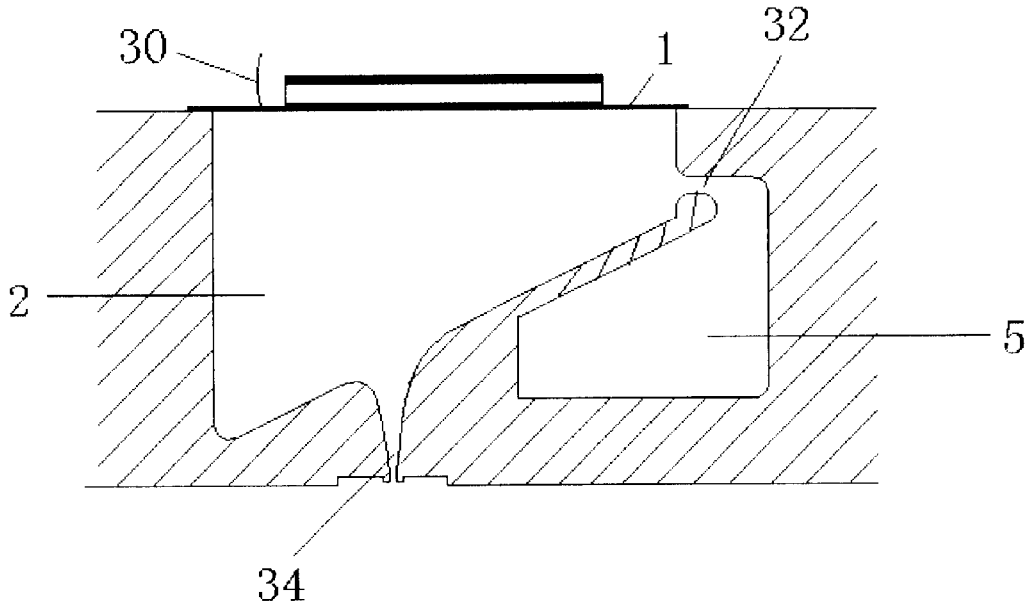
FIG. 12 is a cross sectional view of the ink jet head according to the present invention.

FIG. 12 is a cross sectional view showing an example of the ink jet head fabricated by the above manner of the present invention. The ink jet head also has an ink pressurizing chamber 2 defined on the back by an oscillator plate 1 driven by a piezoelectric/electrostrictive driver 30, an ink feed inlet 32 for feeding the ink from an ink feed chamber 5 into the ink pressurizing chamber 2, and an ink discharge opening 34 for ejection of the ink from the ink pressurizing chamber 2.

Figure 13:
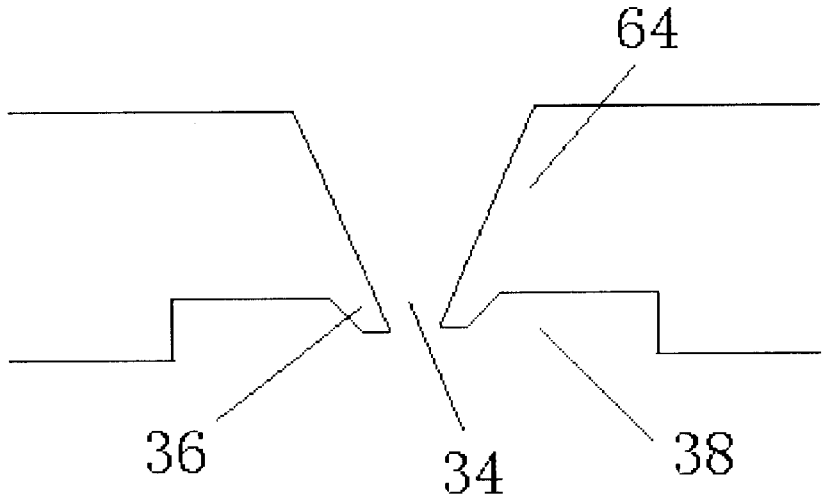
FIG. 13 is an enlarged cross sectional view of the ink jet head according to the present invention.

FIG. 13 is an enlarged cross sectional view of the ink jet head of the present invention showing an example of the ink discharge opening 34. A projection 36 (a raised portion) is provided about the ink discharge opening 34 on the printing paper side of a ceramic body 64 of the ink jet head. The height of the projection is not smaller than one micrometer. Also, a recess 38 of not smaller than one micrometer in depth is provided about the ink discharge opening 34. This arrangement prevents the ink from sticking about the ink discharge opening 34.

Figure 14:
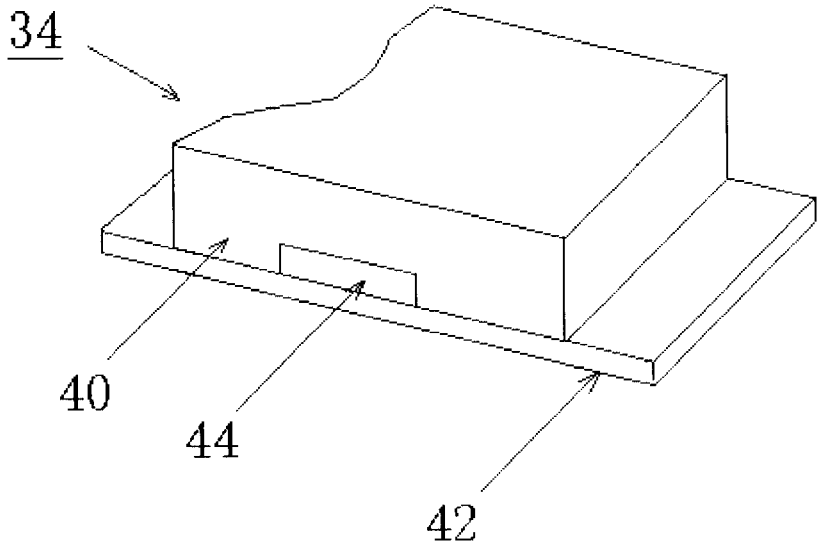
FIG. 14 is an explanatory view showing a process for providing the ink discharge opening in a ceramic body.

FIG. 14 illustrates a method of providing the ink discharge opening in the ceramic body. The method starts with depositing a resin layer 44 between a ceramic layer 40 and a support layer 42. The support layer 42 may be made of a metallic material. The thickness and the hardness of the resin layer 44 are determined depending on the height of the projection about the ink discharge opening. The resin layer 44 is sized to extend up to the outer edge of the recess.

Figure 15:
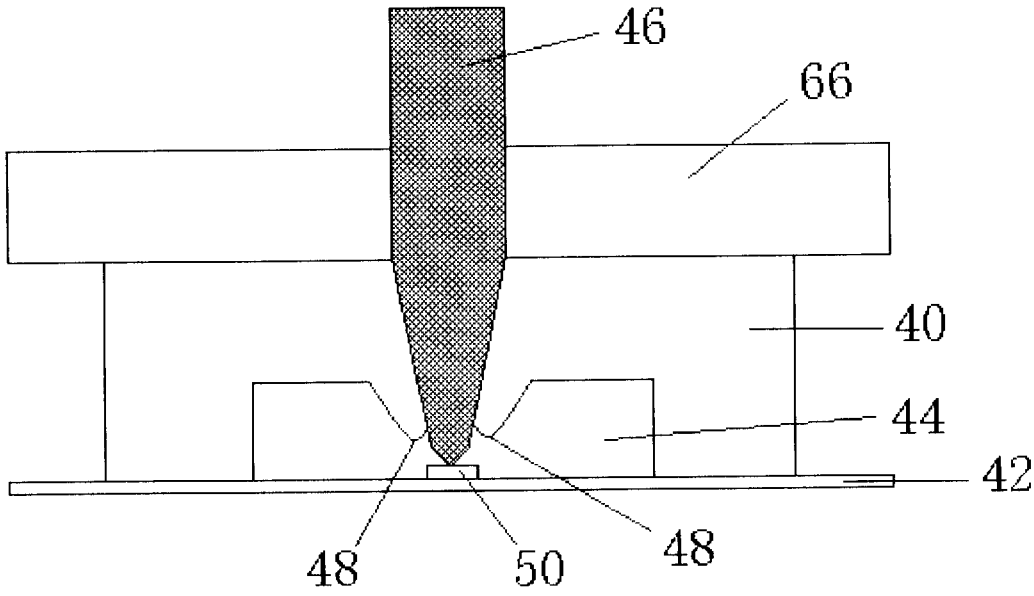
FIG. 15 is a view showing a punch lowered down during the process for providing the ink discharge opening.

FIG. 15 illustrates a forming punch 46 piercing from the above through the ceramic layer 40 and the resin layer 44 of the shape and size provided above the support layer 42. As the punch 46 presses down, it develops a projection 48 of the ceramic layer 40 into the resin layer 44 as shown in FIG. 15. Also, a recess defined by the resin layer 44 is formed about the projection 48 in the ceramic layer 40. Denoted by 66 is a hold-down member of a metallic material which also acts as a bolster for separating the green ceramic assembly from the forming punch after the punching process. Denoted by 50 is a stopper for the punch 46. The resin layer 44 is evaporated during the sintering process, leaving a ceramic form which has the ink discharge opening therein as shown in the cross section in FIG. 13.

Figure 16:
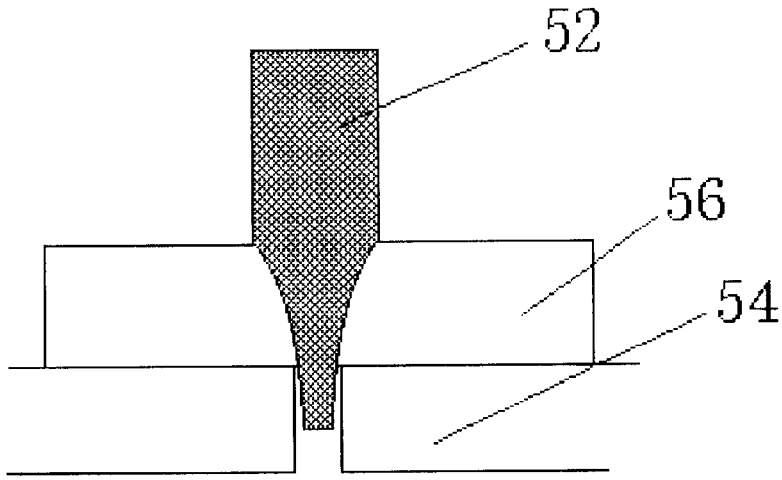
FIG. 16 is a view showing a process for providing the ink discharge opening in a metallic body.
Figure 17:
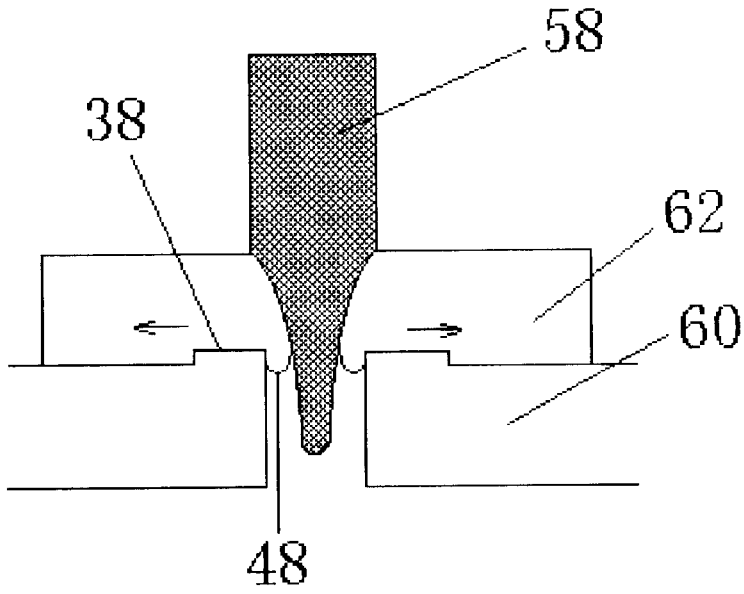
FIG. 17 is a view showing a process for coining the metallic body provided with the opening shown in FIG. 16.
Figure 18:
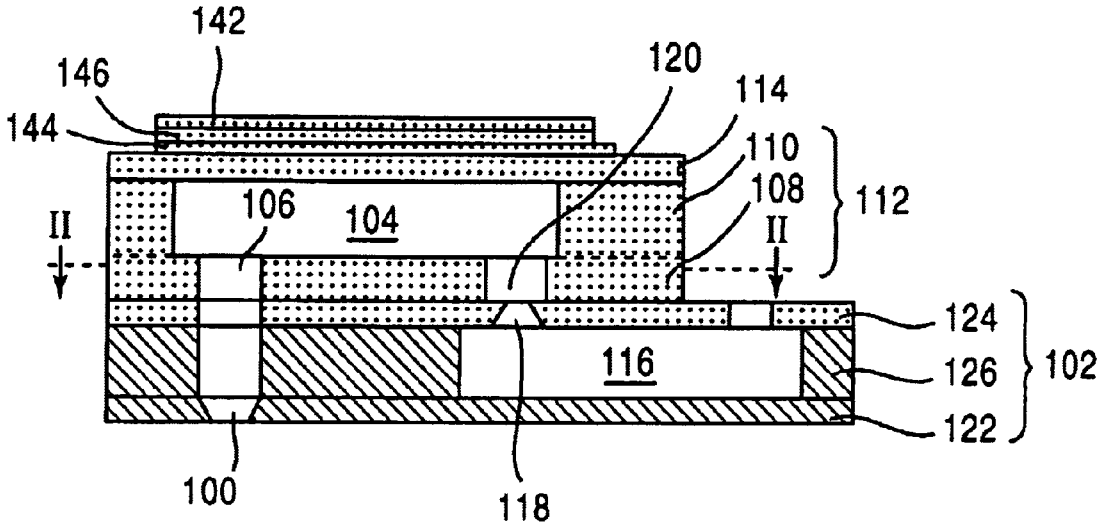
Fig. 18 PRIOR ART
FIG. 18 is a cross sectional view of a conventional ink jet head for a printer disclosed in Japanese Patent Laid-open Publication (Heisei)6-40030.
Figure 19:
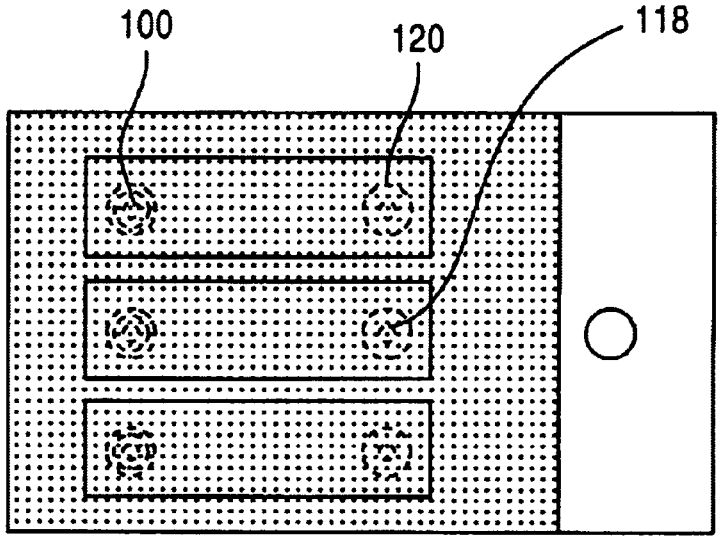
Fig. 19 PRIOR ART
FIG. 19 is a cross sectional view taken along the line II—II.
Figure 20:
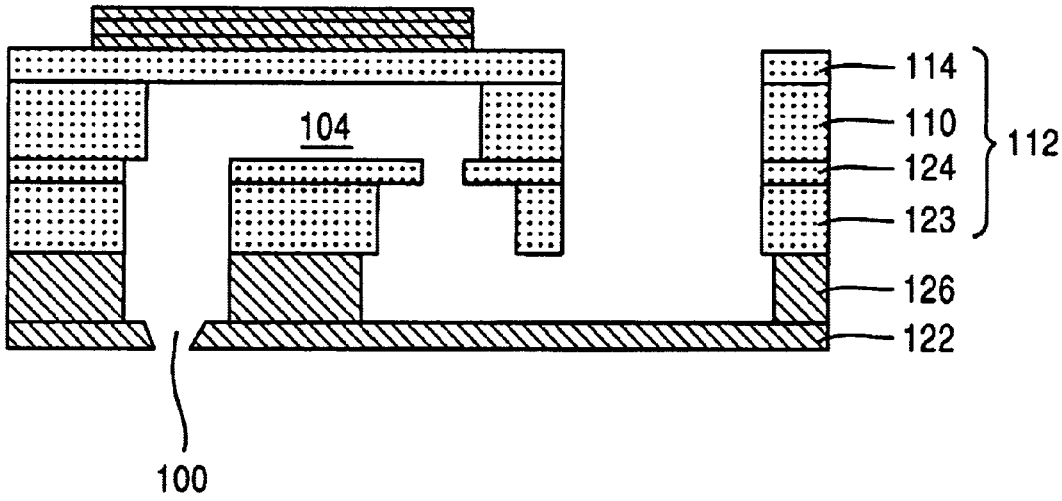
Fig. 20 PRIOR ART
FIG. 20 is a cross sectional view of a conventional ink jet head for a printer disclosed in Japanese Patent Laid-open Publication (Heisei)8-238763.
Figure 21:
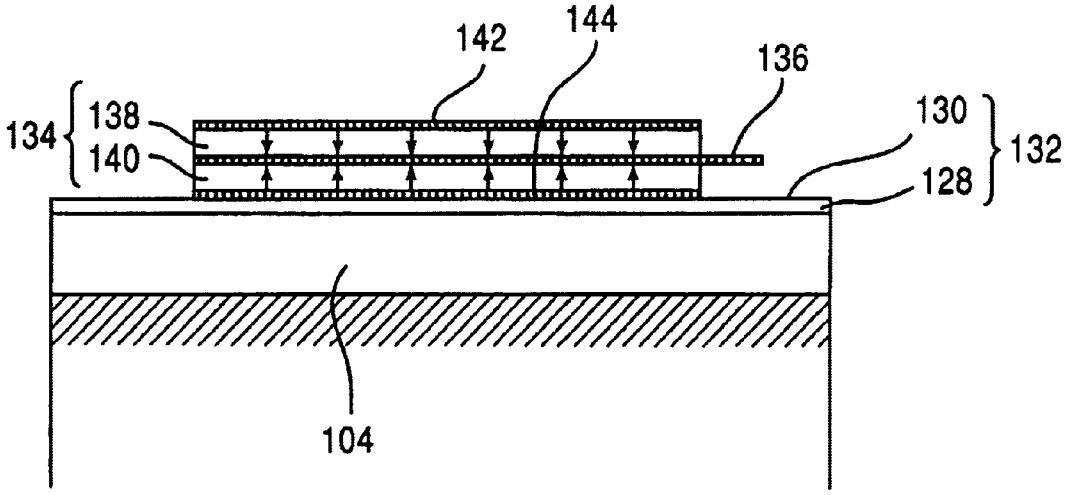
Fig. 21 PRIOR ART
FIG. 21 is a cross sectional view of a conventional ink jet head equipped with a bi-morphous type piezoelectric/electrostrictive element.
Figure 22:
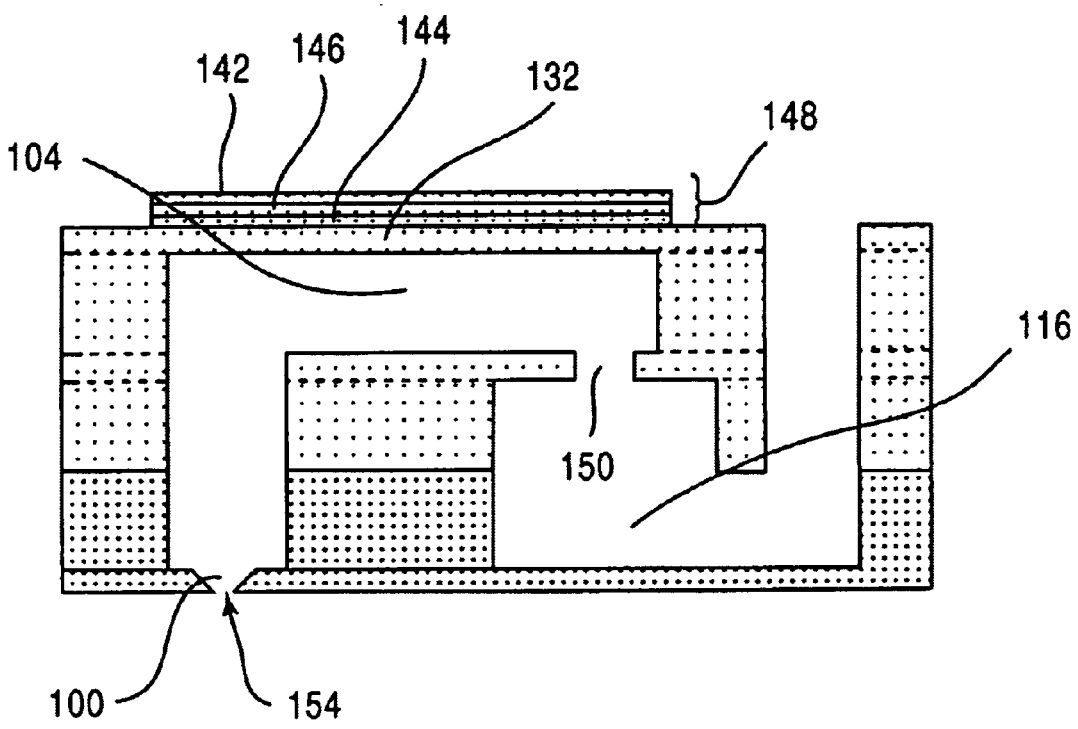
Fig. 22 PRIOR ART
FIG. 22 is a cross sectional view showing a conventional ink jet head for a printer with its ink discharge opening.
Figure 23:
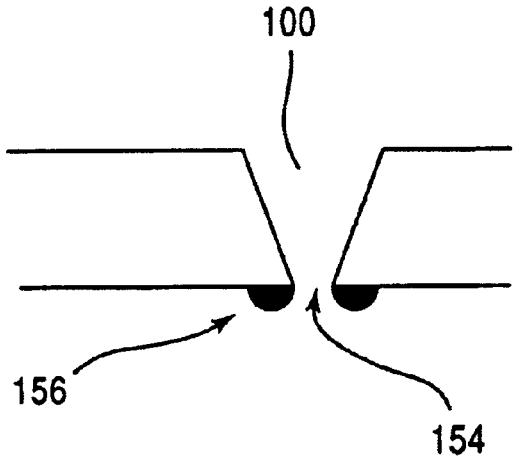
Fig. 23 PRIOR ART
FIG. 23 is an enlarged cross sectional view showing an example of the ink discharge opening in the ink jet head.

The ink discharge opening may be formed in a metallic material. After the metallic material 56 is pierced with a pair of a punch 52 and a die 54, it is subjected to coining for having a projection 48 and a recess 38 as shown in FIG. 17. In FIG. 17, denoted by 58 is a coning punch and 60 is a forming die. Denoted by 62 is a metallic form shaped by the process shown in FIG. 16.

Moreover, according to the present invention, a known thin film depositing method may be used to form a very thin film of a volatility-resistant material, such as silicon resin or perfluorohydrocabon, on the inner and outer wall about the ink discharge opening for restricting the remaining of the ink. Also, the height of the projection 48 and the depth of the recess 38 and their unevenness can favorably be corrected by controlling the thickness of the volatility-resistant thin film.

Advantage of the Invention

As apparent from the above detailed, explicit description, the ink jet head of the present invention comprises an ink chamber, an ink discharge passage, and an ink discharge orifice arranged in an integral assembly of ink head material layers exhibiting higher sealing effects and having no steps or undulation in the inner wall which may interrupt the propagation of a shock wave thus to transfer the pressure for discharge applied to the ink to the ink discharge opening at optimum efficiency, as well as comprising an ink feed passage and an ink feed orifice for smooth feeding of the ink, whereby blockage of the ink will be minimized and interference with neighbor heads arranged in an array will be avoided. Also, a method of fabricating the ink jet head according to the present invention is provided which allows the shock wave even if its frequency is shortened and its waveform is acute to be readily propagated without significant loss, hence contributing to the smaller size and the faster ejection timing of the ink jet head.

More particularly, while the shock wave is propagated from the oscillator plate throughout the ink to the ink discharge orifice without significant loss, it can intensively eject a droplet of the ink. Simultaneously, a fresh supply of the ink can be drawn in while hardly being affected by the shock wave. Thanking to the favorable shape of the ink discharge passage, dried segments of the ink can be released out without difficulty. In addition, the drying out of the ink can be prevented by oscillating the ink during the standby or non-printing mode. As a result, the blockage with the ink will be minimized. As every corner of the ink pressurizing chamber is rounded, the generation of air bubbles will be decreased. The provision of the slits between any two adjacent ink jet heads in an array can avoid undesired interference between the two heads. The body of the ink jet head is constructed by a solidified layers assembly of a ceramic or glass material, thus encouraging the down-sizing, the high-density arrangement, the high-speed operation, and the energy-saving.

The ink jet head of the present invention for use in a printer is successfully equipped with an ink jet driver having a uni-morphous type piezoelectric/electrostrictive element of which the polarization is slant against the electrode surfaces, thus permitting the oscillator plate to oscillate up and down at higher effectiveness. Accordingly, the vertical oscillation can efficiently be changed to a powerful pressing force for ejection of the ink and to a suction force to receive a fresh supply of the ink.

The ink jet head of the present invention has the tip of its ink discharge orifice projected properly and the annular recess provided about the projection in the paper side thereof, hence preventing ink from creeping around and dropping down in a mist and improving the quality of printed letters and images. Accordingly, the arrangement of the shape of the ink pressurizing chamber and the ink discharge orifice and a control system for the oscillation can be simplified without accounting heavily the creeping of the ink. The ink jet head of the present invention is preferably fabricated by placing a resin layer beneath the layers arrangement of a ceramic material deposited layer by layer, placing a support layer beneath the resin layer, pressing down a forming punch to form the projection and the recess about the projection at one time, and sintering the assembly to remove the resin layer. The ink discharge opening can be provided in a metallic body of the head. In that case, the projection and the recess can be provided by coning an de-burring the metallic body. The advantageous effects of the projection and the recess provided on the metallic body are identical to those of the ceramic layers assembly.

We claim:

1. An ink jet head comprising:

a body having an oscillator plate with an outer surface and an inner surface, wherein the inner surface is parallel to the outer surface;

an ink pressuring chamber formed in the body between the inner surface and an opposed lower wall, wherein the lower wall is angled relative to the inner surface;

an ink feed chamber formed in the body;

an ink feed passage formed in the body communicating between the ink feed chamber and the ink pressuring chamber, the ink feed passage having an ink feed orifice opening into the ink pressuring chamber; and an ink discharge passage formed through the lower wall of the body communicating with a discharge orifice, the ink discharge passage having an inlet at the ink pressuring chamber and terminating at the discharge orifice, wherein the ink discharge passage is continuously narrowed from the ink pressuring chamber to the discharge orifice.

2. An ink jet head according to claim 1, wherein the ink feed passage has at least one bend.

3. An ink jet head according to claim 1, wherein several pieces of said body are arrayed in a line, between each of which a slit is formed in a perpendicular direction from the outer surface of the body.

4. An ink jet head according to claim 1, wherein the oscillator plate of the body has an ink jet driver thereon having a piezoelectric/electrostrictive member.

5. An ink jet head according to claim 4, wherein the piezoelectric/electrostrictive member is a uni-morphous type, comprising: a lower electrode plate combined with the oscillator plate of the body; a piezoelectric/electrostrictive element provided on the lower electrode plate; and an upper electrode plate provided on the piezoelectric/electrostrictive element, wherein the piezoelectric/electrostrictive element has a polarization inclined to the plane of the electrode plates.

6. An ink jet head according to claim 4, wherein the ink jet driver has a ratio, tp/ts, of the thickness tp of the piezoelectric/electrostrictive element to the thickness ts of the oscillator plate is within a range from 0.3 to 0.7.

7. An ink jet head according to claim 5, wherein when a voltage is applied between the upper electrode plate and the lower electrode plate, the piezoelectric/electrostrictive member is expanded in the upward and downward direction, so as to exert pressure on an ink filled in the ink pressurizing chamber.

8. An ink jet head comprising:

a body having a oscillator plate with an outer surface and an inner surface, wherein the inner surface is parallel to the outer surface;

an ink pressuring chamber formed in the body between the inner surface and an opposed lower wall, wherein the lower wall is angled relative to the inner surface;

an ink feed chamber formed in the body;

an ink feed passage formed in the body communicating between the ink feed chamber and the ink pressuring chamber, the ink feed passage having an ink feed orifice opening into the ink pressuring chamber; and an ink discharge passage formed through the lower wall of the body communicating with a discharge orifice, the ink discharge passage having an inlet at the ink pressuring chamber and terminating at the discharge orifice.

9. An ink jet head according to claim 8, wherein the ink discharge passage is continuously narrowed from the ink pressuring chamber to the discharge orifice.

10. An ink jet head according to claim 8, wherein the ink feed passage has at least one bend.

11. An ink jet head according to claim 8, wherein the discharge orifice is provided in a projection extending from a lower surface of the body.

12. An ink jet head according to claim 11, wherein the discharge orifice is projected from the lower surface of the body, by at least one micrometer.

13. A ink jet head according to claim 8, wherein a lower surface of the body is recessed around the discharge orifice.

14. An ink jet orifice according to claim 13, wherein the lower surface of the body is recessed around the discharge orifice, by at least one micrometer.

15. An ink jet head according to claim 8, wherein several pieces of said body are arrayed in a line, between each of which a slit is formed in a perpendicular direction from the outer surface of the body.

16. An ink jet head according to claim 8, wherein the oscillator plate of the body has an ink jet driver thereon having a piezoelectric/electrostrictive member.

17. An ink jet head according to claim 16, wherein the piezoelectric/electrostrictive member is a uni-morphous type, comprising: a lower electrode plate combined with the oscillator plate of the body; a piezoelectric/electrostrictive element provided on the lower electrode plate; and an upper electrode plate provided on the piezoelectric/electrostrictive element, wherein the piezoelectric/electrostrictive element has a polarization inclined to the plane of the electrode plates.

18. An ink jet head according to claim 16, wherein the ink jet driver has a ratio, tp/ts, of the thickness tp of the piezoelectric/electrostrictive element to the thickness ts of the oscillator plate is within a range from 0.3 to 0.7.

19. An ink jet head according to claim 17, wherein when a voltage is applied between the upper electrode plate and the lower electrode plate, the piezoelectric/electrostrictive member is expanded in the upward and downward direction, so as to exert pressure on an ink filled in the ink pressurizing chamber.

* * * * *